US005103937A

United States Patent [19]

Robertson

[11] Patent Number: 5,103,937

[45] Date of Patent: Apr. 14, 1992

[54] SWAY MINIMIZATION SYSTEM FOR ELEVATOR CABLES

[76] Inventor: Leslie E. Robertson, 45 E. 89th St. No. 25C, New York, N.Y. 10128

[21] Appl. No.: 677,635

[22] Filed: Mar. 28, 1991

[51] Int. Cl.[5] ..... B66B 9/00

[52] U.S. Cl. ..... 187/1 R; 187/20; 254/389; 174/42

[58] Field of Search ..... 187/1 R, 20, 22, 23, 187/95; 254/389; 174/72, 146, 147

[56] References Cited

U.S. PATENT DOCUMENTS

| | | | |
|---|---|---|---|
| 1,145,914 | 7/1915 | Magnuson | 187/1 R |
| 3,295,832 | 1/1967 | Fowler | 254/190 |
| 3,662,862 | 5/1972 | Poller | 187/95 |
| 3,666,051 | 5/1972 | Davis et al. | 187/1 R |
| 4,079,816 | 3/1978 | Ohta | 187/1 R |
| 4,117,908 | 10/1978 | Nara et al. | 187/20 |
| 4,664,229 | 5/1987 | Obst | 187/1 R |
| 4,716,989 | 1/1988 | Coleman et al. | 187/1 R |

FOREIGN PATENT DOCUMENTS

| | | | |
|---|---|---|---|
| 1013-284-A | 4/1983 | U.S.S.R. | 187/95 |

*Primary Examiner*—Robert P. Olszewski
*Assistant Examiner*—Kenneth Noland
*Attorney, Agent, or Firm*—Curtis, Morris & Safford

[57] ABSTRACT

A system for limiting oscillation of a stationary or moving elevator cable attached to suspended elevator equipment in an elevator shaft. The system includes a cable oscillation limiting member located at a predetermined vertical position in the elevator shaft. The limiting member is movable between an extended position vertically in line with the suspended elevator equipment and horizontally proximate the cable in its free-hanging state and a retracted position vertically out of line with the equipment and horizontally distal the cable. The extended position tends to limit oscillations of the cable and the retracted position permits the elevator equipment to pass the member without interference from the member or members and without substantial contact between the elevator equipment and the member under normal operating conditions. The system includes sensors to determine the need for moving the limiting member between its extended and retracted positions, depending upon the position of the elevator. The system may also use the magnitude of forces tending to induce oscillations in the cable for determining when to move the limiting member to and from the extended and retracted positions.

18 Claims, 11 Drawing Sheets

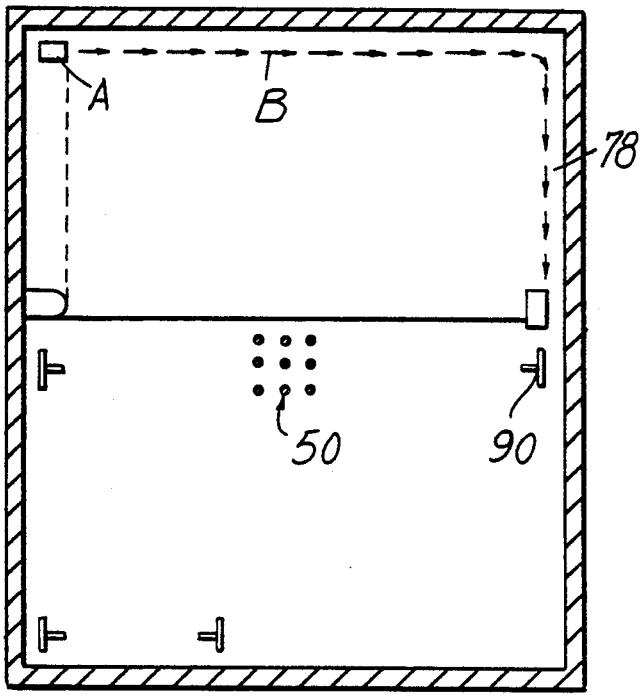
FIG. 22
FIG. 23
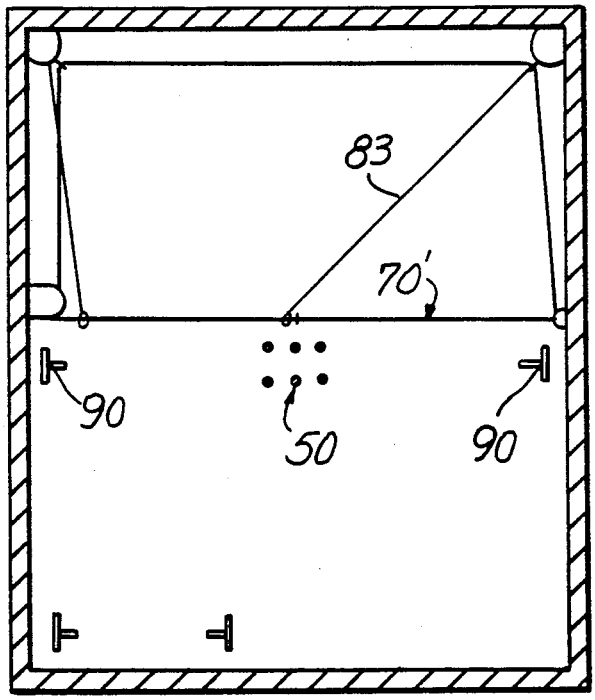
FIG. 24
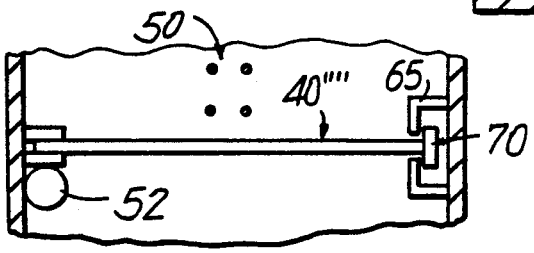

SWAY MINIMIZATION SYSTEM FOR ELEVATOR CABLES

FIELD OF THE INVENTION

The present invention relates to elevators and cable systems therefor, and in particular to a system and method for limiting oscillations in elevator cable systems.

BACKGROUND OF THE INVENTION

The oscillation of elevator cables, that is, cables having one end attached to an elevator car or to an elevator counterweight and being movable therewith, has been an ongoing problem for many years. Cable oscillations may be induced by the swaying motion of the structure, such as caused by wind, earthquake or other natural forces. Energy inputs particularly apt to induce cable oscillation are those where the energy input produces a lateral effect on the cable at or near one or more of the natural frequencies of oscillation of the cable. Cable oscillation may also be induced by air flow within the elevator shaft, such as that caused by stack action or elevator car movement. The motion of the elevator car itself may also contribute to elevator cable oscillation as the cable travels along with the car. Wind and earthquake-induced building oscillation can also be severely detrimental, leading to impacting of elevator cables against shaft walls, tangling of cables and the like.

All elevator cable systems, including the hoisting, compensating and electrical cables, can have oscillations induced with building motion and can develop resonance. The most severe difficulties are commonly encountered under the following conditions:

1) When building motion is induced by the wind or earthquake;
2) When the elevator is stopped at a floor wherein the natural frequency of lateral oscillation of the cable coincides nearly coincides with the natural frequency of lateral oscillation of the building, often where the cable length is at or near a maximum;
3) While the car is stopped and oscillatory motion is coupled from the building into the cables for some period of time; and
4) When the elevator moves toward the other end of the cable, thus tending to shorten the cable, while oscillations are present in the cable.

For the compensating cables and suspended utility cables such as control, power and communication cables, the most severe case generally occurs after the car has been parked at an upper floor, where the cable is at its maximum unsupported length, for some period of time. During subsequent descent of the elevator, oscillation coupled from the building into the cables is increased in frequency of vibration and sometimes amplified in amplitude by the continuous shortening of the cable, much as the oscillation of a violin string is amplified as the finger moves down the bridge.

It can be shown that the swaying motions of tall buildings and the swaying modes of elevator cables within these buildings fall at or near one or more of the natural frequencies of oscillation of both building and cable.

The period of oscillation of a tall building (fundamental approximately equal to N/10, where N is the number mode) is very of stories in the building. For more or less constant tension and weight, the period of oscillation of a free cable is proportional to some function of its length. For hoist cables and the like (i.e., cables suspended from above and supporting a load such as an elevator car or counterweight) the natural frequency of oscillation takes the form:

$$\text{Frequency} = \frac{K}{2L} \frac{[T + W/2^{\frac{1}{2}}]}{M}$$

$K$ = 1 for the first mode
$K$ = 2 for the second mode, etc.
$T$ = Tension applied to bottom of cable
$W$ = Total weight of cable
$M$ = mass of cable per unit of length
$L$ = total length of cable For compensating cables, electrical cables and the like (i.e., cables suspended at each end), the frequencies are more complex but are of the form:

$$\text{Frequency} = f\left(\frac{R}{L} \frac{[W/2^{\frac{1}{2}}]}{M}\right)$$

where $R$ is complex variable dealing with the actual configuration of the suspended cable From these expression it can be seen that by providing temporary lateral support to elevator cables (i.e., moving member 40 and/or member 70 to its extended position), at intermediate points of the shaft, the free vibration length of the cable can be effectively significantly reduced. For cables laterally supported at both ends, a support near the midpoint will double the natural frequency of the cable, supports near the third points triple the natural frequency of the cable and so forth.

The problems of cable oscillation tend to worsen as building height increases. This is because of:

a) the increased wind-induced dynamic oscillation of taller buildings;
b) the increased elevator speeds in taller buildings and
c) the tendency toward resonance of elevator cables with the natural period of taller buildings.

Various approaches to ease the problem of cable oscillation in elevator cables have been proposed. In one system, described in U.S. Pat. No. 1,145,914, excessive oscillation of a suspended electrical cable for an elevator is prevented by means of a stationary wire stretched vertically to one side of the path of the elevator between the bottom of the elevator and the top of the side wall of the shaft. This system cannot, however, be used to limit oscillation of the compensation and/or hoisting cables for the elevator. This system is also limited in oscillation can only be prevented in a side to side direction and only at the bight of the cable. Accordingly, this system is not readily adaptable to modern high rise structures.

In another proposal, described in U.S. Pat. No. 3,666,051, a horizontal guide member through which cables of the elevator pass is supported at an intermediate vertical location by stops on tracks on either side of the path of the elevator. When the elevator reaches the guide as it is raised, the elevator picks up the guide and causes it to be raised therewith. This system is disadvantageous in that noise and thumping can occur when the elevator reaches the guide, which can be disconcerting to passengers.

In another system, a dynamic damper consisting of an offset weighted bar is attached to the hoisting cables of the elevator near the elevator. This is said to cause lateral oscillations o the cable to be converted to twisting motions. This system, however, does not primarily limit the oscillations, but rather causes the oscillations to be damped once the have occurred. This system also apparently damps the motion of the cables at least in part by internal friction within the cables themselves, which can increase cable wear. Furthermore, the system is not readily adaptable to the suspended cables.

In another system, described in U.S. Pat. No. 4,117,908, oscillation of hoisting cables is limited by fixed guides positioned near the top of the shaft. However, because these guides are located near the top of the elevator path, to accommodate the guides, the elevator shaft must be built somewhat higher than would otherwise be necessary. Furthermore, because the guides can only practically extend a small portion of the length of the shaft, the effectiveness of this system in limiting oscillations of the cable at the midpoint of the cable is limited.

Various other approaches have been tried, including various damping systems, the use of traveling cars, the slowing of elevator cars, and programs for controlling the parking or continuous motion of elevator cars at levels within the elevator shaft so as to minimize the buildup of resonance-induced oscillator energy within the elevator cables. None, however, has proven entirely successful in limiting oscillations of elevator cables in modern high rise structures, except at very high cost.

OBJECTS OF THE INVENTION

Accordingly, it is an object of the present invention to provide a system and method for limiting oscillations of elevator cables which overcomes the foregoing limitations and disadvantages.

In particular, it is an object of the present invention to provide a system and method for limiting oscillations of elevator cables which can limit oscillations before they occur.

It is another object of the present invention to provide a system and method for limiting oscillations of elevator cables which can be used to limit oscillations of hoisting, counterweight, compensating and electrical cables.

It is a further object of the present invention to provide a system and method for limiting oscillations of elevator cables which can be used on any size building without limitation.

It is a yet further object of the present invention to provide a system and method for limiting oscillations of elevator cables which does not require additional height to be added to the building.

It is still another object of the present invention to provide a system and method for limiting oscillations of elevator cables which operates without noise objectionable to passengers.

It is another object of the present invention to provide a system and method for limiting oscillations of elevator cables which does not significantly increase cable wear.

It is another object of the present invention to provide a system and method for limiting oscillations of elevator cables which is simple, reliable and failsafe.

It is still another object of the present invention to provide a system and method for limiting oscillations of elevator cables which can readily be retrofitted into existing buildings.

SUMMARY OF THE INVENTION

In accordance with a preferred embodiment of the present invention, a method for limiting oscillation of a stationary or moving elevator cable attached to suspended elevator equipment in an elevator shaft is provided having the steps of determining whether or not a predetermined condition exists and when the predetermined condition exists, positioning a cable oscillation limiting member or members located at a predetermined vertical position or positions in the elevator shaft in an extended position vertically in line with the suspended elevator equipment and horizontally proximate the cable in its free-hanging state whereby the member or members will limit oscillations of the cable. When the predetermined condition does not exist, the method includes the step of positioning the member or members in a retracted position vertically out of line with the equipment and horizontally distal the cable to permit the elevator equipment to pass the member or members without interference from the member or members and without substantial contact between the elevator equipment and the member or members under normal operating conditions.

In a refinement of this embodiment of the invention, the method further includes the step of determining whether or not sufficient clearance exists between the elevator equipment to prevent substantial contact between the elevator equipment and the member under normal operating conditions and the predetermined condition requires at least the existence of such clearance.

In another embodiment of the invention, a system for limiting oscillation of a stationary or moving elevator cable attached to suspended elevator equipment in an elevator shaft is provided having a cable oscillation limiting member located at a predetermined vertical position in the elevator shaft. The member is movable between an extended position vertically in line with the elevator equipment and horizontally proximate the position of the cable in its free-hanging state whereby oscillation greater than a predetermined amount will be limited by contact between the member and the cable. The member further has a retracted position vertically out of line with the elevator equipment and horizontally distal the cable so that the elevator equipment will be able to pass the member without interference from or substantial contact with the member. The system further includes means for determining whether a predetermined condition exists and means responsive to the existence of the predetermined condition to move the member from the retracted position to the extended position when the predetermined condition exists and from the extended position and the retracted position when the predetermined condition does not exist, this movement being accomplished without substantial contact between the elevator equipment and the member under normal operating conditions.

In a refinement of this embodiment, the system further includes means for determining whether sufficient clearance exists between the elevator equipment and the cable oscillation limiting member to prevent contact between them under normal operating conditions.

The present invention minimizes cable oscillations by providing lateral support to the cables. This effectively "shortens" the cables, thus separating the natural frequencies of oscillation of the building from the natural frequencies of oscillation of the cables by increasing the frequency of the cables out of the range of building oscillation. Additionally, the devices of the present invention limit cable motion at the point of the device. Both features tend to reduce the buildup of oscillatory energy within the cable thereby limiting excessive oscillation. Furthermore, devices in accordance with the present invention can also be constructed with the use of damping devices so as to consume a part of such energy of oscillation as may build up in the cable or cables.

BRIEF DESCRIPTION OF THE DRAWINGS

These and other objects, features and advantages of the present invention will be apparent to those skilled in the art upon review of the following detailed description in conjunction with the figures, wherein:

FIG. 22 is a plan view of another preferred embodiment of a retractable wire-type cable limiting device having a transporter, shown in the extended position;

FIG. 23 is a plan view of another preferred embodiment of a retractable wire-type cable limiting device for use where there may be interference from elevator guide rails, having recovery cables, shown in the extended position; and FIG. 24 is a plan view of a retractable cable oscillation limiter of the semaphore type having an opposing anchor guide, employed in a preferred embodiment of the system of the present invention, shown in the extended position.

DETAILED DESCRIPTION

Figure 1:
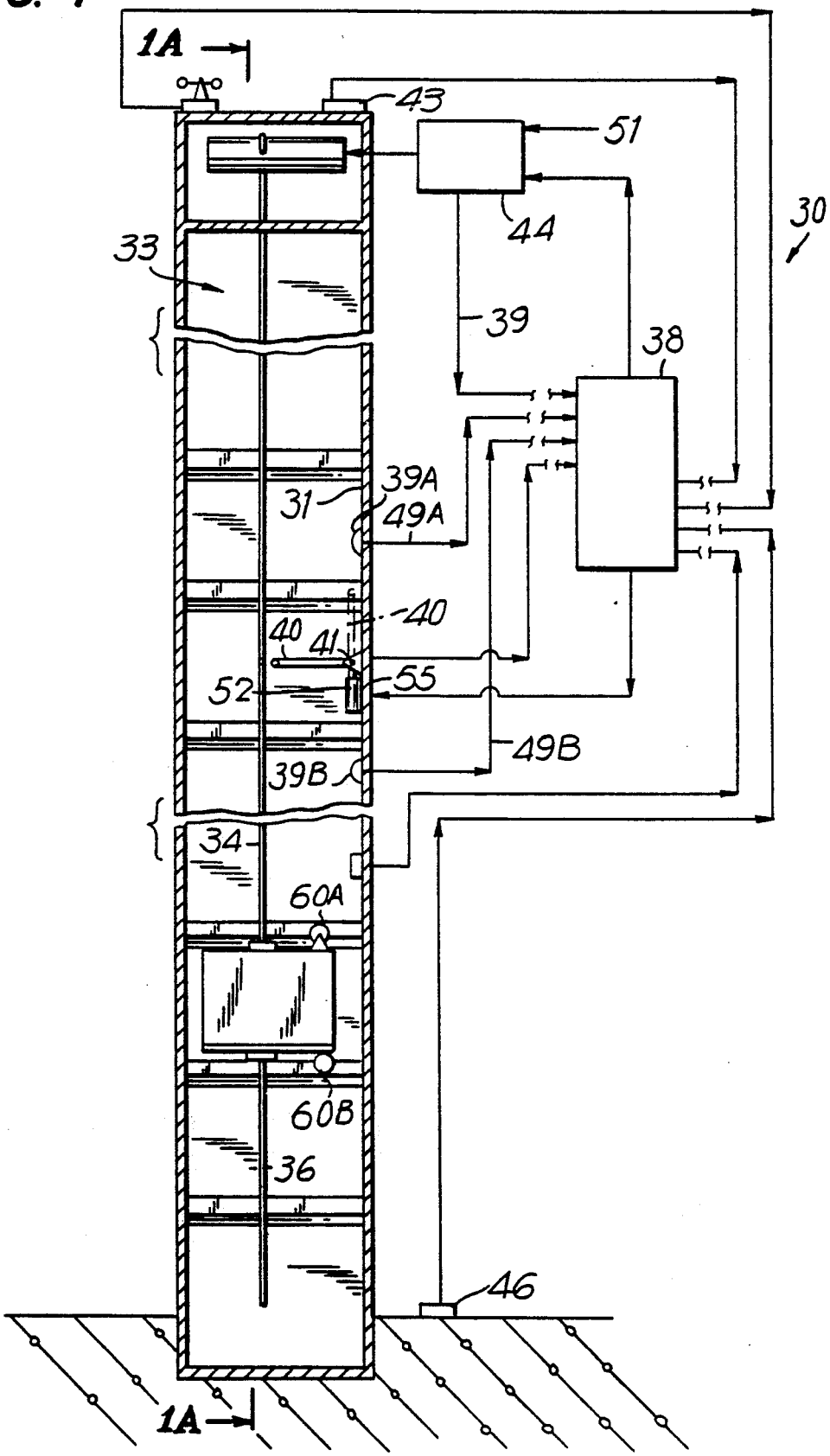
FIG. 1 is an elevational view of a cable oscillation limiting system in accordance with a preferred embodiment of the present invention, taken along the line 1—1 of FIG. 1A, installed in an elevator shaft.
Figure 1A:
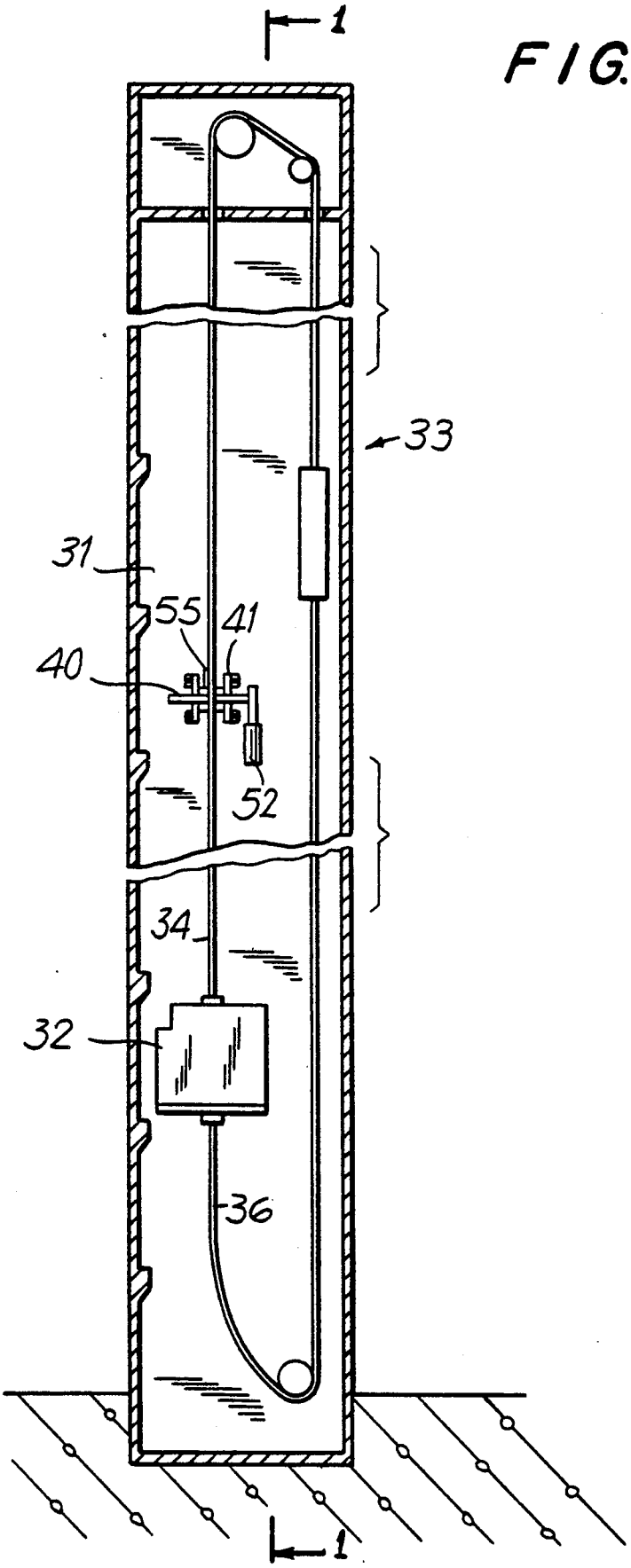
FIG. 1A is an elevational view of a cable oscillation limiting system in accordance with a preferred embodiment of the present invention, taken along the line 1A—1A of FIG. 1, installed in an elevator shaft.

Turning now to the drawings in detail, and initially to FIGS. 1, and IA thereof, a cable oscillation limiting system 30 in accordance with a preferred embodiment of the present invention is depicted. The system 30 includes a "semaphore" oscillation limiting member 40 swingably mounted by means of bracket 41 to a wall 31 of the elevator shaft 33 at a predetermined vertical location in the shaft. To maximize the effectiveness of the device, this vertical location is preferably away from either end of the shaft, generally near the midpoint of the shaft.

Figure 2:
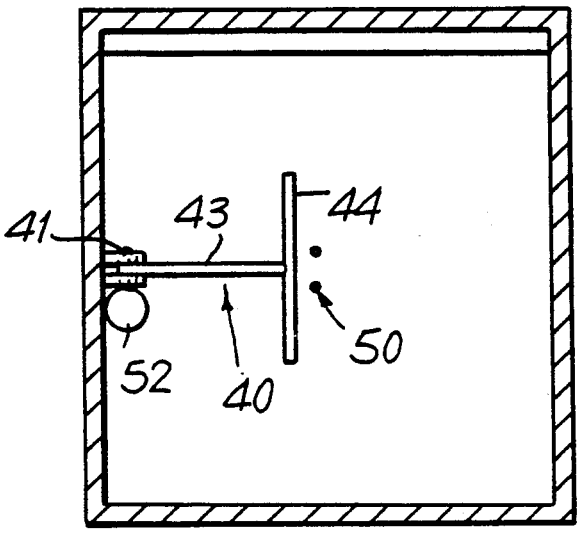
FIG. 2 is a plan view of a retractable cable oscillation limiter of the semaphore type employed in a preferred embodiment of the system of the present invention, shown in the extended position.
Figure 3:
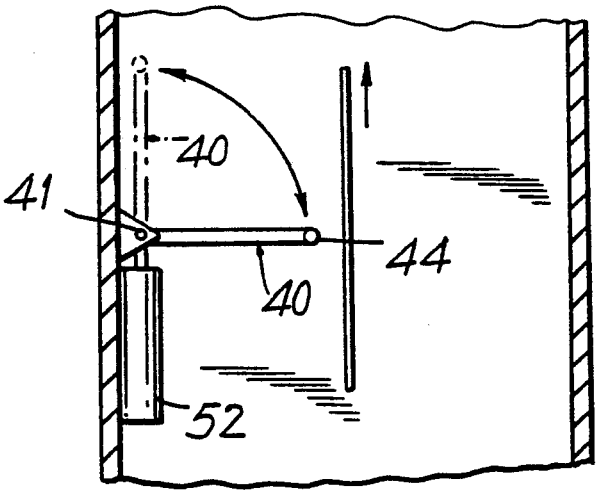
FIG. 3 is an elevation view of the retractable cable oscillation limiter depicted in FIG. 2.
Figure 4:
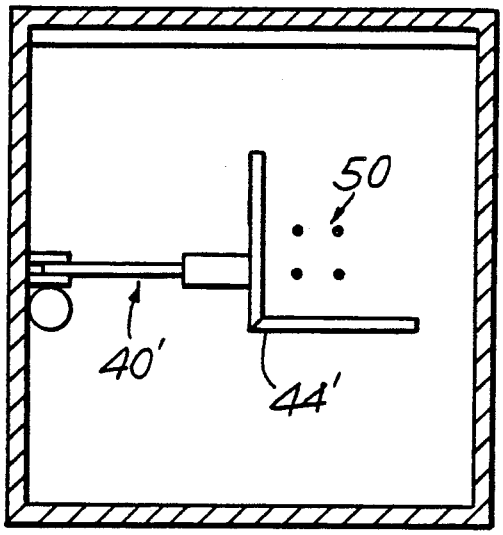
FIGS. 4, 5 and 6 are plan views of different configurations of the retractable cable oscillation limiter depicted in FIG. 1.
Figure 5:
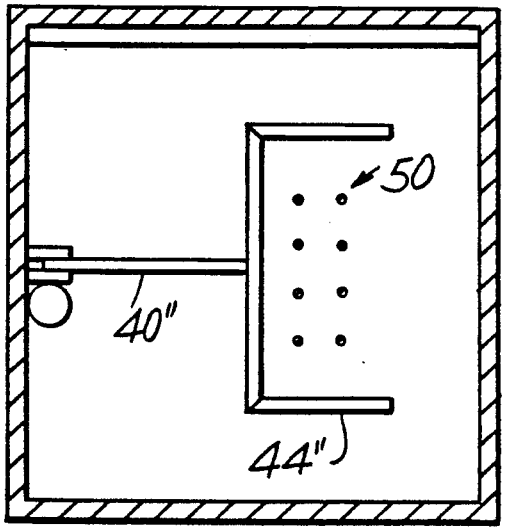
Figure 6:
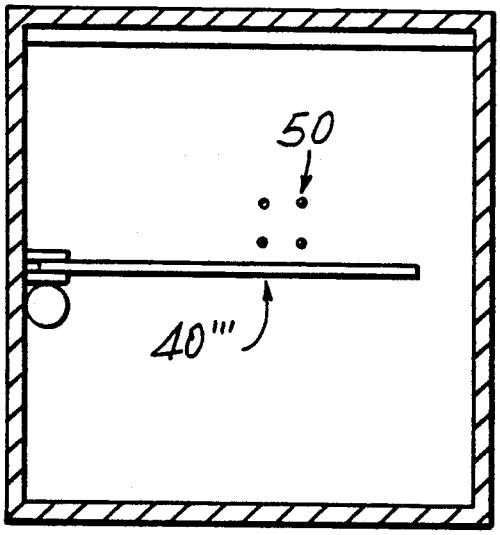
Figure 7:
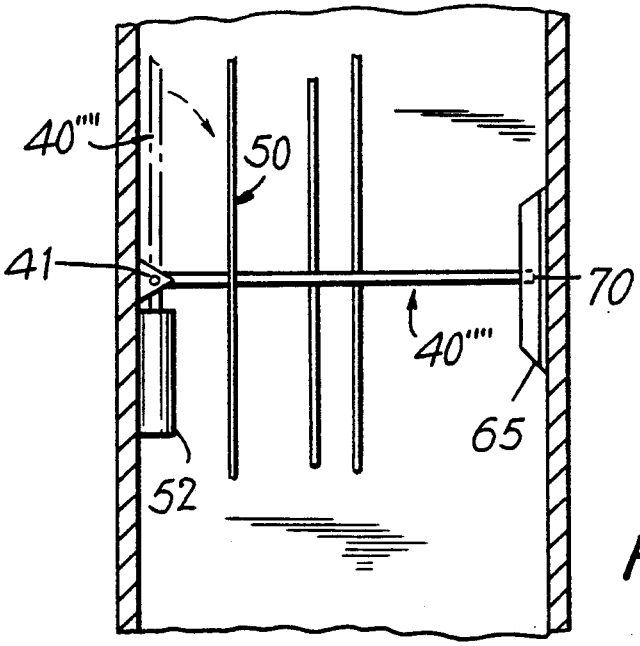
FIG. 7 is an elevation view of a retractable cable oscillation limiter of the semaphore type having an opposing anchor guide employed in a preferred embodiment of the system of the present invention, shown in the extended position, between two cables.
Figure 8:
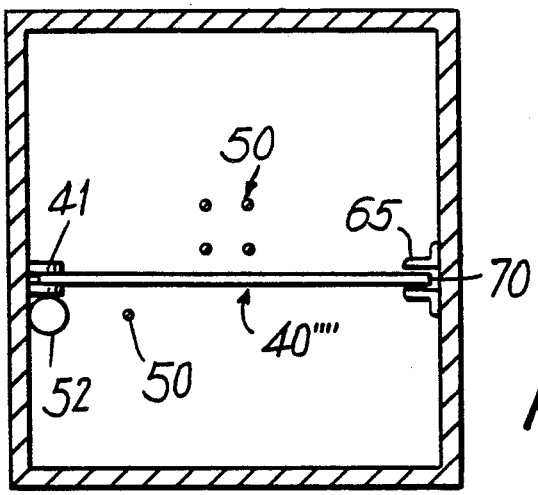
FIG. 8 is a plan view of the retractable cable oscillation limiter depicted in FIG. 7.
Figure 9:
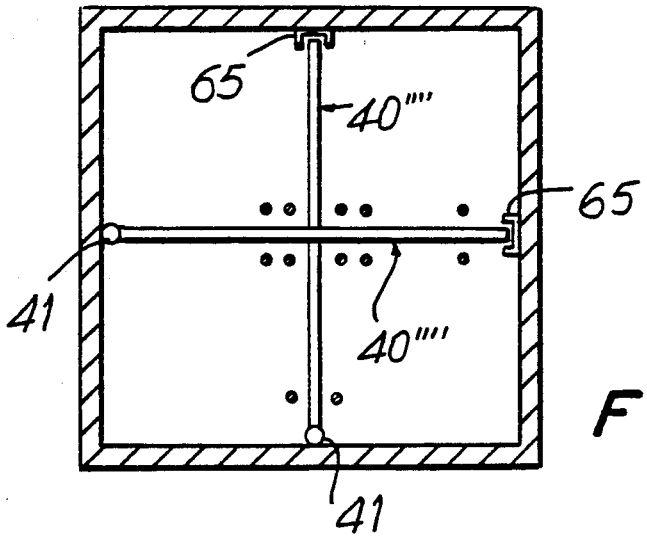
FIG. 9 is a plan view of two retractable cable oscillation limiters of the semaphore type having opposing anchor guides employed in a preferred embodiment of the system of the present invention, shown in the extended position, between pairs of cables.
Figure 10:
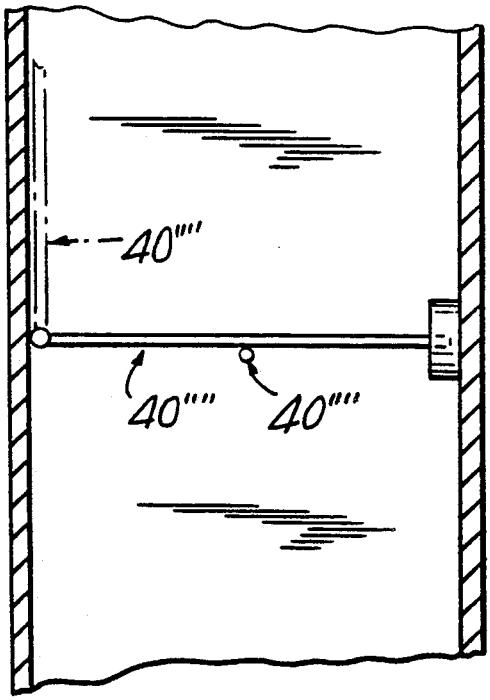
FIG. 10 is an elevation view of the retractable cable oscillation limiters depicted in FIG. 9.

Member 40 is conveniently constructed as a "T" bar with a beam 43 and cross bar 44, as depicted in FIGS. 2 and 3. However, a variety of other configurations may be employed depending upon the circumstances of the installation and characteristics of the cable system. Examples of limiting members 40', 40''and 40''' having different configurations are depicted in FIGS. 4-6.

Returning now to FIG. 1, member 40 is movable between an extended position which is vertically in line with elevator car 32 and horizontally proximate the centrally mounted hoist cable 34 in its free hanging state, and a retracted position which is away from the cable 34 and vertically out of line with elevator car 32. In FIG. 1, member 40 is depicted in the extended position in solid lines, and in the retracted position in dotted lines. The limiting member in its extended position need not actually contact the cable in its free hanging state, although some contact in this condition would not generally be detrimental. Contact will occur, however, when the cable attempts to oscillate.

Although the retracted position is depicted as above bracket 41, the member 40 can be alternatively be made movable to a corresponding position below bracket 41. The member 40 can also be made to swing in a horizontal, rather than a vertical plane. It should be noted that, although the present invention is depicted and described as operating on the elevator car cables, it also may be employed to like effect on the cables attached to the counterweight, the compensating cables and on the utility cables. It should be further noted that with the elevator cable configuration depicted, compensation cable 36 is also centrally mounted on the elevator car. Accordingly, the extended position of the member 40 would also be horizontally proximate the compensation cable 36 and its retracted position would be horizontally distal to it.

As can be seen, the limiting member 40 in its extended position extends into the elevator shaft and would, accordingly, interfere with the passage of the elevator car. Modern high rise elevators may move at speeds in excess of 30 miles per hour and contact between moving elevator equipment and limiting member 40 under normal operating conditions is undesirable. Accordingly, the movable limiting member 40 is preferably moved to the retracted, noninterfering, position before the elevator car contacts it, preferably when a sufficient safe clearance exists between the limiting member and the elevator car. This will prevent possible damage to the elevator car and limiting member, as well as prevent noise objectionable to passengers which would otherwise likely be caused by contact between the elevator car and the limiting member 40.

An actuator 52 is employed to move limiting member 40 between its extended and retracted positions. Actuator 52 may be of any convenient design, including a pneumatic cylinder, hydraulic cylinder, electric motor. An electric motor is preferred, however, because of its greater convenience for most installations.

A controller 38, which may conveniently be a suitably programmed microprocessor, is used to command actuator 52 to move cable limiting member 40 between its retracted position and its extended position, depending upon whether or not a predetermined condition is met. Such predetermined condition preferably include at least the existence of sufficient clearance between the elevator car and the limiting member 40, that is, that the elevator car would not contact cable limiting member 40 if it were moved to its extended position.

The existence of such clearance can be determined in a variety of acceptable manners. The simplest manner would be to input the vertical location information already present in the elevator controller 44 (which is conventionally present and used for operating the elevator) to the limiter controller 38. In FIG. 1, this information is schematically shown being input to controller 38 by means of input line 39. In addition to this, or alternatively, dedicated sensors 39A and 39B, which may be conveniently optical, electrical or magnetic sensors, can be placed in the elevator shaft above and below the position of the limiting member 40 to sense the presence or passage of the elevator car directly. Output from these sensors would then be feed to controller 38 and hence to controller 44 via lines 49A and 49B to thus inform the controllers of the proximity of the elevator car to the limiting member 40.

Preferably, the controller 38 is programmed to ensure that the limiting member 40 is moved to its retracted position before contact between the elevator car and the member can occur can be used to determine whether the limiting member 40 is to be moved to its extended or retracted position. For example, in general, it is preferable that the member 40 be retracted unless the elevator car is stationary. This will prevent friction between the otherwise moving cables and the member 40. To prevent excessive movement of the member between its extended and retracted position, information from elevator controller 44 as to whether there is a pending floor request, and to which floor, can be input to the controller 38. Thus, for example, if there is a pending floor request to a floor in the direction of or past the position of the member 40, the controller 38 can be programmed to prevent movement of member 40 to the extended position or to retract it, since movement to the retracted position would be required soon in any event.

Oscillations, in general, require a period of time to build up, and do not tend to build up to as great an extent when the elevator is moving up and down, thus frequently changing the effective length of the cables. Accordingly, it some installations it may be desirable to retract the member 40 unless the elevator is "parked" for a period of time. Thus, for example an additional condition could be the absence of any pending floor request for the elevator car in any direction and/or nonmotion of the elevator for a predetermined period of time.

As another example, it may be desirable in certain installations that the devices be kept in the retracted position when little oscillation limiting is required, such as during times where building motion, or other oscillation inducing energy, is small. Thus, in this example, the measurement of conditions associated with unacceptably higher amplitudes would, in addition to the presence of sufficient clearance between the limiting member 40 and the elevator car, become an additional requirement of the predetermined condition necessary before the limiting member 40 would be caused to move into its extended position. To determine this condition, the cable motion can be sensed directly, such as by magnetic sensor 47. An accelerometer 43 to monitor buildings motion can also be used to measure building motion. Alternatively, or in addition to this, an anemometer 45 can be used to provide wind speed information to the controller, since wind will tend to induce building motion after a period of time. An accelerometer 46 could also be used to monitor ground acceleration caused by seismic forces. Any or all of this information can be input to controller 38 to enable it to determine whether this additional condition required for extension of the member 40 has been met.

Under some circumstances, it may be desirable to permit the member 40 to be extended at certain times even when the car is in motion. This might be desirable in exceptionally tall buildings where oscillations tend to be large more frequently. In this case, the controller 38 would preferably be programmed to permit extension of the member 40 (providing other conditions were met) except when the elevator was moving toward, or about to move toward, member 40.

Elevator controller 44, as is conventional, has a feedback system designed to preclude elevator car motion at times when certain safety systems (such as doors, for example) are not in their proper positions. Information from a variety of such safety systems is commonly input to controller 44, schematically represented as input 51. It is preferred to include the proposed oscillation limiting system in the feedback network so as to be able to inform controller 44 of the position of member 40. The position of the limiting member 40 can be determined in a variety of manners, including by means of limit switches, sensors, or other such means. In the embodiment of the system depicted in FIG. 1, a limit switch 55 is used.

As noted above, preferably, controller 44 is programmed to preclude any car motion unless the limiting member 40 is in its fully retracted position. However, in cases where it is desired to permit the member 40 to be extended during motion of the car, controller 44 can be programmed instead to permit car motion under some circumstances, such as when such motion is in a direction away from the member 40.

These control schemes are exemplary only, however, since the appropriate control scheme for a particular installation will depend upon factors unique to that installation, such as the height and natural frequency of the building, average wind speeds, acceptable amplitude of oscillations, frequency of use of the elevator, etc.

The number of cable oscillation limiting members that may be necessary or desirable for a given building will depend upon the height and oscillation characteristics of the building and cable system. Although only one cable oscillation limiting member 40 is depicted, two or more may also be employed, if necessary. Often, such as in relatively short buildings, only one device may be needed. However, the installation of two or more devices may be desirable in taller structures and allows cables to be "tuned" to nearly any desired natural frequency higher than the natural frequency of the uncorrected system.

It should be noted that for cable motion in a given plane, a limiting member need only be provided in one direction, i.e., on one side of the cables, to reduce oscillations in both opposing directions. However, limiting members can be provided on both sides, if desired.

The semaphore cable limiting member may be configured to have an end which anchors in a guide on an opposing wall. This is depicted in FIGS. 6–9 and 24. The limiting member 40''' is configured in the same way as the limiting member depicted in FIG. 6, with the exception that the limiting member is long enough to reach the opposing wall and that it has an enlarged end 70. At the opposing wall, there is a anchor guide 65 which cooperates with enlarged end 70 to retain it in position. During motion from the retracted position to the extended position, the elongated end 70 will fit into the anchor guide 65, thereby more securely holding the limiting member in place.

On lateral impact from the elevator cables, the limiting member would be deflected in the direction of cable movement. Once a limit of deflection is achieved, the anchor guide will prevent further motion, and the limiting member goes into tension. As depicted in FIGS. 7–9 and 24, this configuration is readily adaptable to installations where it is desired to interdigitate the limiting member between cables. Of course, it is not required that the limiting member pass between cables.

Figure 11:
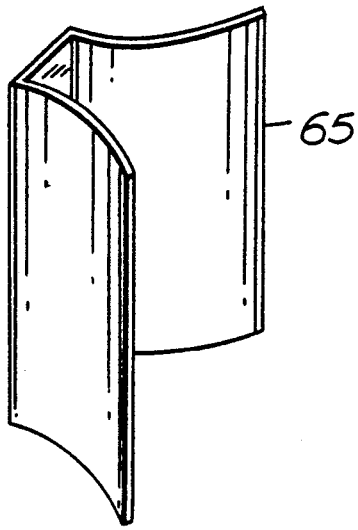
FIGS. 11 and 12 are perspective views of illustrative embodiments of anchor guides adapted for use in the present invention.
Figure 12:
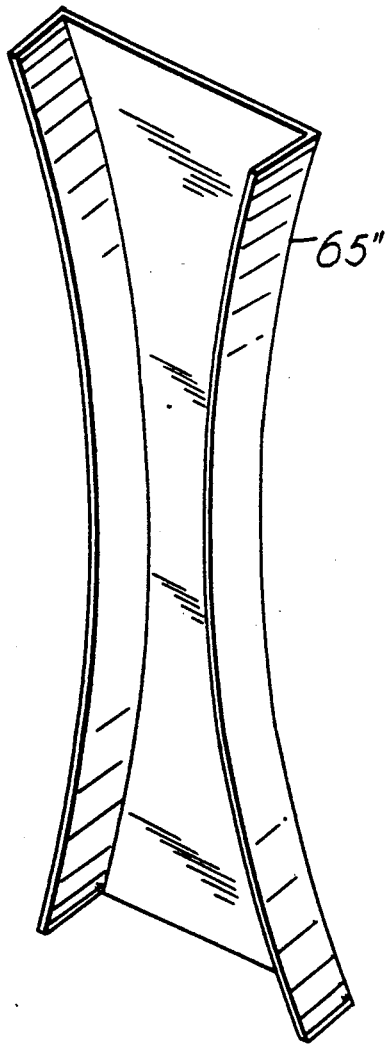
Figure 13:
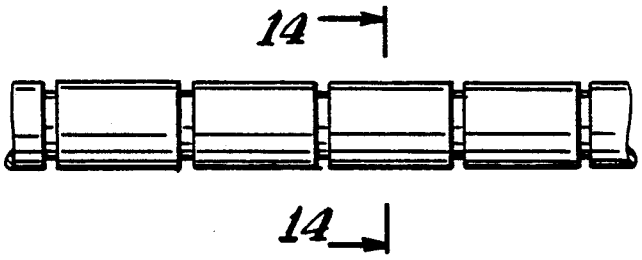
FIG. 13 is an elevational view of an illustrative embodiment of a portion of a cable oscillation limiter having a low friction surface.
Figure 14:
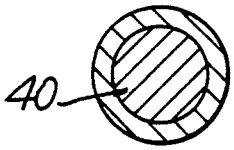
FIG. 14 is an end view of section 14—14 of the portion of the cable oscillation limiter depicted in FIG. 13.

The anchor guides can be tapered or flared as depicted in FIGS. 11 or 12 as 65' and 65'' to allow for easy entry of the limiting member. This will also provide strength and stiffness. Preferably, the limiting member is made electrically conductive and electrical contacts are provided on the anchor guide to facilitate informing controller 38 of when the limiting member is fully in the extended position and properly positioned in the guide.

Figure 16:
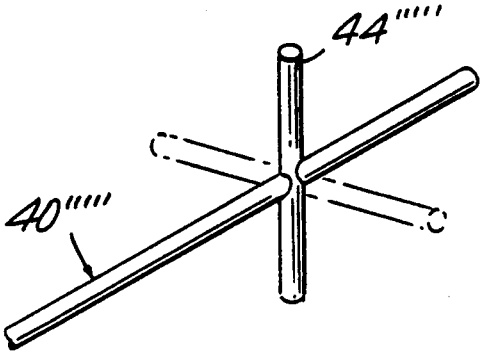
FIG. 16 is a perspective view of a T-shaped rotatable cable oscillation limiter adapted rotate the "T" portion into position between the cables after the cable oscillation limiter is in position.
Figure 17:
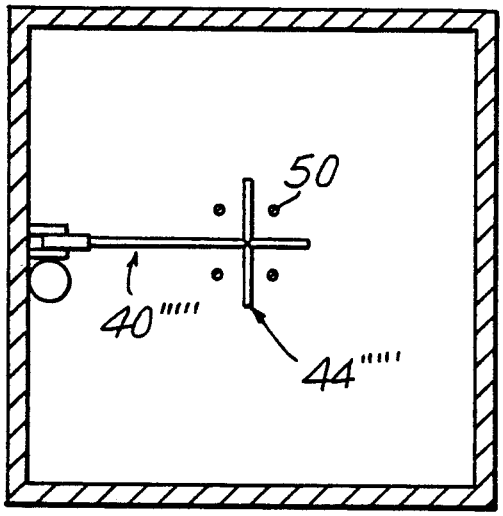
FIG. 17 is a plan view of the T-shaped rotatable cable oscillation limiter depicted in FIG. 16, shown in its rotated position between the cables.

In some installations it may be desirable to rotate the limiting member once it is in position to more securely prevent the cables from moving. With reference to FIGS. 16 and 17, the limiting member 40'''''' has a cross configuration with a cross member 44'''''' Initially, member 40'''''' is swung into its extended position with the cross beam 44'''''' in the vertical orientation. Once it is in this extended position, with the cross bar in between the cables, the control mechanism rotates the limiting member 40'''''' until the cross beam 44'''''' is in the position depicted in FIG. 17.

The foregoing examples of semaphore cable limiting member constructions are exemplary only, since a variety of configurations will be appropriate for various installations depending upon cable configurations and shaft design.

In the event of failure of both of the retraction mechanism and of the electrical feedback network that prevents the elevator from moving, it is desirable that the device be swept aside by the passing elevator car without it affecting the life safety features of the elevator system. That is, the device (which projects into the elevator shaft) should be designed to be "fail-safe" so that, in the event of failure of control systems, the elevator car can pass the device without danger to passengers or serious damage to the car. Fittings to the top and the bottom of the car, which are conveniently rollers 60A and 60B are preferably installed for this purpose.

The limiting member 40 can be made to be frangible such that it will be partially or wholly destroyed by unintended impact by the elevator car without serious damage to the elevator car or other elevator equipment. To accomplish this, cable limiting member 40 can be constructed of post-tensioned beams which are designed to self-destruct into relatively small pieces or by other methods.

Figure 15:
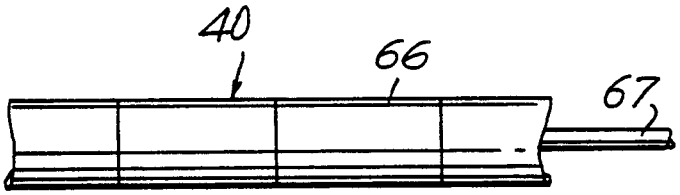
FIG. 15 is a elevational view, partly in section, of a portion of a post-tensioned cable oscillation limiter adapted for self-destruction in the event of unintended impact with elevator equipment.

An example of a limiting member having such a frangible construction is depicted in FIG. 15. The beams of limiting member 40 are constructed of an outer layer having relatively short pieces 66 of high strength material with an inner wire 67 such as is used in post-tensioning systems. These pieces 66 have ends finished to allow full bearing on abutting pieces. Tensile load in the wire is transferred onto pieces 66 so as to create beam strength in the guide pole B, and further to provide electrical conductivity, if desired.

In the event of accidental impact by the elevator car (or for other reasons) the wire 67 is designed to break (or its anchorages designed to fail) so as to allow the beam to safely break up into small pieces.

Figure 18:
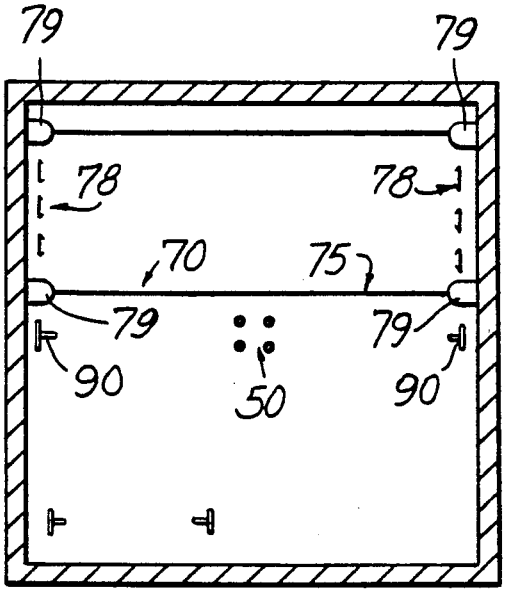
FIG. 18 is a plan view of a retractable wire-type embodiment of a cable limiting device in accordance with another preferred embodiment cf the present invention, shown in the extended position.

It is not required that the limiting member be a relatively stiff beam as depicted in FIGS. 1 through 17. A configuration wherein a flexible wire alone is used as the limiting member is depicted in FIGS. 18 through 23. Turning first to FIG. 18, the limiting member is a wire stretching across the elevator shaft along a wall when it is in its retracted position. When it is desired to limit oscillations of the elevator cables, the ends of wire 70 is moved into position by transporters 79 sliding in tracks 78 on each side of the elevator shaft.

Figure 19:
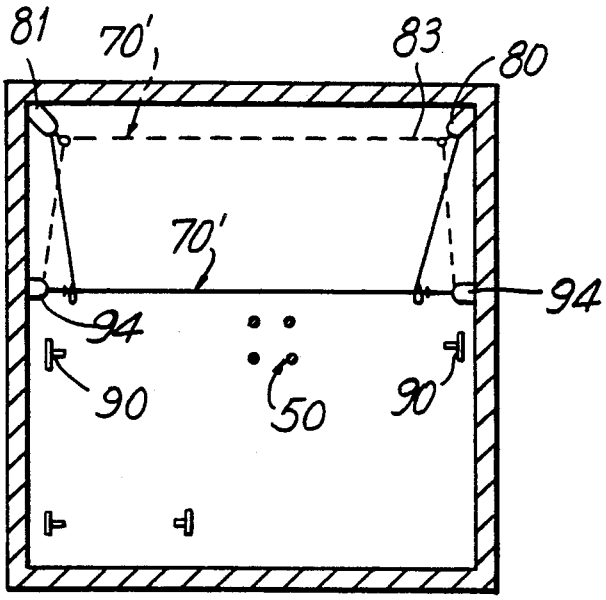
FIG. 19 is a plan view of another embodiment of a retractable wire-type cable limiting device in accordance with a preferred embodiment of the present invention, having recovery cables, shown in the extended position.

Another configuration of a wire type cable limiter is depicted in FIG. 19. In this configuration, a recovery cable 83 is used to move the wire 70' from its retracted position indicated by the dotted line and its extended position indicated by the solid line. The wire is wound on and off of reels 94 and the recovery cable is wound back and forth on reels 80 and 81 powered by preferably an electric motor (not shown). In other respects, the control system for wire-type systems is substantially the same as described previously with respect to FIG. 1.

Figure 20:
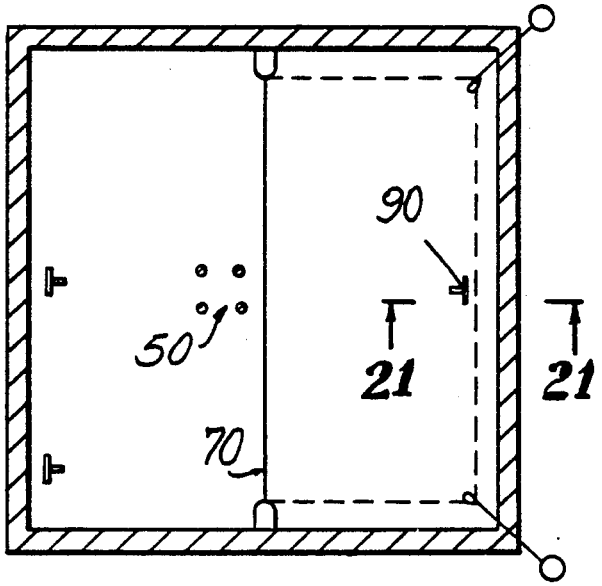
FIG. 20 is a plan view of a retractable wire-type cable limiting device in accordance with a preferred embodiment of the present invention for use where it may be acceptable to pass the wire through the elevator guide rails, shown in the extended position.
Figure 21:
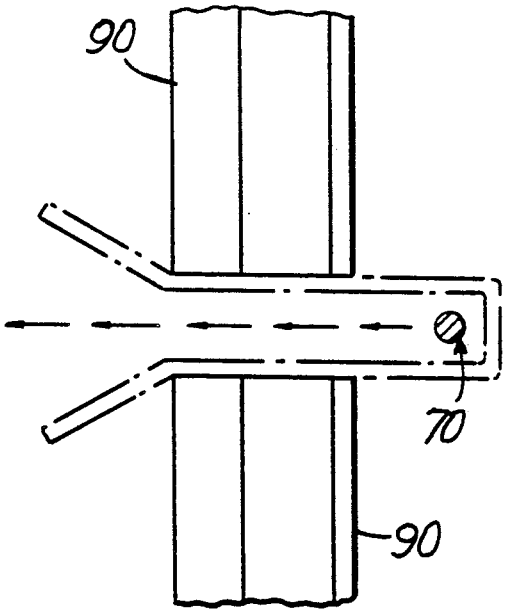
FIG. 21 is a detail of the portion of a retractable wire-type cable limiting device passing through an elevator guide rail, shown in the retracted position.

Elevator shafts commonly have guide rails 90 along their periphery for guiding the elevator up and down in a smooth straight line. In certain installations, the guide rail 90 may interfere with the retraction of wire. In unusual situations, it may not be possible to pass the wire through the line of the rail. In this event, a beam type configuration such as depicted in FIGS. 1 through 17 would be preferable. However, in most installations, it may be acceptable to a small slot in the guide rail 90 to permit passage of the wire. Such a configuration is depicted in FIGS. 20 and 21.

In a wire type system, the motor used to power the winding and unwinding of the wire can be conveniently used to damp the motion of the elevator cable. To do so, the control system for the motor may be designed so that as the cable strikes the wire, the motor will provide a level of torque which just allows the wire to unreel at an amount and at a rate which maximizes the energy expended by the motor. As the cable motion is stopped by the wire, the motor is designed to provide only enough torque to reel in the wire. This prevents the consumed energy from being reintroduced into the cables. A variety of other friction and viscous dampers can also be employed.

Although the various embodiment of the present invention have been shown and described, there is no intention of limiting the present invention to only those embodiments, since many variations and equivalents of the present invention will be apparent to those skilled in the art. Rather, the scope of the present invention is defined by the appended claims.

I claim:

1. A method for limiting oscillation of a moving elevator cable attached to suspended elevator equipment elevator equipment in an elevator shaft, said method comprising the steps of determining whether or not a predetermined condition exists, when said predetermined condition exists, positioning a cable oscillation limiting member located at a predetermined vertical position in said elevator shaft in an extended position vertically in line with said equipment and horizontally proximate said cable in its free-hanging state whereby said member will limit oscillations of said cable; and when said predetermined condition does not exist, positioning said member in a retracted position vertically out of line with said equipment and horizontally distal said cable which permits said elevator equipment to pass the member without interference from said member and without substantial contact between said elevator equipment and said member under normal operating conditions.

2. The method defined in claim 1, wherein said method further included the step of determining whether or not sufficient clearance exists between said elevator equipment to prevent substantial contact between said elevator equipment and said member under normal operating conditions and wherein said predetermined condition requires at least the existence of said clearance.

3. The method defined in claim 2, wherein said predetermined condition further requires the lack of vertical motion of said elevator for a predetermined period of time.

4. The method defined in claim 2, wherein said predetermined condition further requires the lack of a pending floor request.

5. The method defined in claim 2, wherein said method further comprises the determination of the magnitude of an energy state which tends to induce cable oscillations, said predetermined condition further requiring the existence of energy state greater than a predetermined magnitude.

6. The method defined in claim 2, wherein said method further comprises the determination of the magnitude of cable oscillations, said predetermined condition further requiring the existence of cable oscillations greater than a predetermined amount.

7. The method defined in claim 2, wherein said predetermined vertical position is at least a substantial distance from either end of said elevator shaft.

8. The method defined in claim 2, further comprising the step of absorbing oscillatory energy from said cable by damping when said cable means contacts said member.

9. A system for limiting oscillation of a moving elevator cable attached to suspended elevator equipment in an elevator shaft, said system comprising a cable oscillation limiting member located at a predetermined vertical position in said elevator shaft, said member being movable between an extended position vertically in line with said elevator equipment and horizontally proximate the position of the cable in its free-hanging state whereby oscillation greater than a predetermined amount will be limited by contact between said member and said cable and a retracted position vertically out of line with said elevator equipment and horizontally distal said cable so that said elevator equipment will be able to pass said member without interference from or substantial contact with said member;

means for determining whether a predetermined condition exists;

means responsive to the existence of said predetermined condition to move said member from said retracted position to said extended position when said predetermined condition exists and from said extended position and said retracted position when said predetermined condition does not exist, said movement being accomplished without substantial contact between- said elevator equipment and said member under normal operating conditions.

10. The system defined in claim 8, further comprising means for determining whether sufficient clearance exists between said elevator equipment and said cable oscillation limiting member located at a predetermined vertical position in said elevator shaft to prevent contact between them under normal operating conditions.

11. The system defined in claim 10, said system further comprising means for determining whether said elevator equipment is moving and means for measuring the passage of time and wherein said predetermined condition further requires the lack of vertical motion of said elevator equipment for at least a predetermined period of time.

12. The system defined in claim 10, said system further comprising means for determining whether there is a pending floor request and wherein said predetermined condition further requires the lack of a pending floor request.

13. The system defined in claim 10, said system further comprising means for sensing the magnitude of an energy state which tends to induce cable oscillations, said predetermined condition further requiring the sensing of at least a predetermined minimum magnitude of said energy state.

14. The system defined in claim 10, said system further comprising means for sensing of the magnitude of cable oscillations, said predetermined condition further requiring the existence of cable oscillations greater than a predetermined amount.

15. The system defined in claim 10, wherein said predetermined vertical position is at least a substantial distance from either end of said elevator shaft.

16. The system defined in claim 10, wherein said member further comprises means for absorbing oscillatory energy from said cable by damping when said cable contacts said member.

17. The system defined in claim 10, further comprising means for physically moving said member from said extended position to said retracted position by physical contact with said elevator equipment to allow said elevator equipment to pass without interference or damage to either said member or said elevator equipment under abnormal operating conditions.

18. The system defined in claim 10, wherein said member is frangible with respect to said elevator equipment so that in the event of failure of said member to move from said extended position to said retracted position, said member will be at least partially destroyed without damaging said elevator equipment or substantially interfering with its operation.

* * * * *

UNITED STATES PATENT AND TRADEMARK OFFICE

CERTIFICATE OF CORRECTION

PATENT NO. : 5,103,937

DATED : April 14, 1992

INVENTOR(S) : Robertson

It is certified that error appears in the above-identified patent and that said Letters Patent is hereby corrected as shown below:

Col. 11, Line 29, change "moving" to --movable--;

Line 30, delete "elevator equipment";

line 45, change "which permits" to --to permit--;

line 51, change "included" to --includes--;

Col. 12, line 1, change "the existance of said energy state" to --that said energy state is--;

line 15, change "moving" to --movable--;

line 37, change "and" to --to--; and line 40, after "between", delete the hyphen Signed and Sealed this Eleventh Day of April, 1995

*Attest:*

BRUCE LEHMAN

*Attesting Officer*

*Commissioner of Patents and Trademarks*